US010699838B2

(12) United States Patent
Tsukada et al.

(10) Patent No.: US 10,699,838 B2
(45) Date of Patent: Jun. 30, 2020

(54) REACTOR AND METHOD FOR PRODUCTION OF CORE BODY

(71) Applicant: FANUC CORPORATION, Minamitsuru-gun, Yamanashi (JP)

(72) Inventors: Kenichi Tsukada, Yamanashi (JP); Masatomo Shirouzu, Yamanashi (JP); Tomokazu Yoshida, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 4 days.

(21) Appl. No.: 16/017,262

(22) Filed: Jun. 25, 2018

(65) Prior Publication Data

US 2019/0013136 A1 Jan. 10, 2019

(30) Foreign Application Priority Data

Jul. 4, 2017 (JP) ..... 2017-131262

(51) Int. Cl.

| | |
|---|---|
| ***H01F 27/28*** | (2006.01) |
| ***H01F 27/26*** | (2006.01) |
| ***H01F 41/02*** | (2006.01) |
| ***H01F 3/14*** | (2006.01) |
| ***H01F 27/30*** | (2006.01) |
| ***H01F 37/00*** | (2006.01) |
| ***H01F 27/38*** | (2006.01) |

(52) U.S. Cl.

CPC ..... *H01F 27/263* (2013.01); *H01F 3/14* (2013.01); *H01F 27/28* (2013.01); *H01F 27/306* (2013.01); *H01F 27/38* (2013.01); *H01F 37/00* (2013.01); *H01F 41/0233* (2013.01)

(58) Field of Classification Search

CPC ..... H01F 27/00–27/36
USPC ..... 336/65, 83, 90, 92, 180–184, 210–215, 336/232–234
See application file for complete search history.

(56) References Cited

U.S. PATENT DOCUMENTS

| | | | | |
|---|---|---|---|---|
| 4,975,670 | A * | 12/1990 | Krinickas, Jr. ..... | H01F 27/303 336/197 |
| 10,373,753 | B2 | 8/2019 | Maeda et al. | |
| 2019/0013136 | A1 | 1/2019 | Tsukada et al. | |

FOREIGN PATENT DOCUMENTS

| | | | |
|---|---|---|---|
| CN | 201122485 | Y | 9/2008 |
| CN | 102939633 | A | 2/2013 |
| CN | 106816279 | A | 6/2017 |
| CN | 106876123 | A | 6/2017 |
| CN | 208608013 | U | 3/2019 |
| EP | 2584572 | A1 | 4/2013 |
| GB | 1571057 | A * | 4/1998 |
| JP | 55080306 | A | 6/1980 |
| JP | 59014621 | A | 1/1984 |
| JP | 61094308 | A | 5/1986 |
| JP | 2000-077242 | A | 3/2000 |

(Continued)

*Primary Examiner* — Tuyen T Nguyen
(74) *Attorney, Agent, or Firm* — RatnerPrestia

(57) ABSTRACT

A reactor includes an outer peripheral iron core composed of a plurality of outer peripheral iron core portions and at least three iron core coils arranged inside the outer peripheral iron core. The at least three iron core coils are composed of iron cores coupled to the plurality of outer peripheral iron core portions and coils wound onto the iron cores. Gaps, which can be magnetically coupled, are formed between adjacent iron cores. The reactor further includes connection parts for connecting the plurality of outer peripheral iron core portions to each other.

2 Claims, 14 Drawing Sheets

(56) References Cited

FOREIGN PATENT DOCUMENTS

| | | | |
|---|---|---|---|
| JP | 2008085286 | A | 4/2008 |
| JP | 2008-210998 | A | 9/2008 |
| JP | 2017059805 | A | 3/2017 |
| JP | 2017103269 | A | 6/2017 |

* cited by examiner $\pi/6$ $\pi/3$ $\pi/2$ $2\pi/3$ $5\pi/6$ $\pi$

REACTOR AND METHOD FOR PRODUCTION OF CORE BODY

CROSS-REFERENCE TO RELATED APPLICATIONS

This application is a new U.S. Patent Application that claims benefit of Japanese Patent Application No. 2017-131262, filed Jul. 4, 2017, the disclosure of this application is being incorporated herein by reference in its entirety for all purposes.

BACKGROUND OF THE INVENTION

1. Field of the Invention

The present invention relates to a reactor and a method for the production of a core body.

2. Description of Related Art

Reactors include a plurality of iron core coils, and each iron core coil includes an iron core and a coil wound onto the iron core. Predetermined gaps are formed between the plurality of iron cores. Refer to, for example, Japanese Unexamined Patent Publication (Kokai) No. 2000-77242 and Japanese Unexamined Patent Publication (Kokai) No. 2008-210998.

There are also reactors in which a plurality of iron core coils are arranged inside an annular outer peripheral iron core. In such reactors, the outer peripheral iron core can be divided into a plurality of outer peripheral iron core portions, and the iron cores may be formed integrally with the respective outer peripheral iron core portions.

SUMMARY OF THE INVENTION

However, since the outer peripheral iron core is divided into a plurality of outer peripheral iron core portions, when the reactor is driven, vibration may occur due to magnetostriction or the like, and the plurality of outer peripheral iron core portions may become misaligned with each other. In this case, there is a risk that the desired magnetic properties may not be obtained. In order to prevent such misalignment, surrounding and connecting the periphery of the outer peripheral iron core with a band has been considered. However, when the connection surfaces between the adjacent outer peripheral iron core portions are flat and are not the most convex portions of the outer peripheral iron core, there is a risk that a slight misalignment may occur along the connection surfaces due solely to the winding of the band. In order to prevent misalignment between the outer peripheral iron core portions due to vibration caused by magnetostriction or the like, it is also possible to provide projections and recesses on the connection surfaces between the outer peripheral iron core portions. However, if the accuracy of the projections and recesses is poor, there is a significant risk that additional gaps will be formed between the connection surfaces when combining the plurality of outer peripheral iron core portions, leading to an increase in the leakage of magnetic flux and an increase in loss.

Thus, a reactor and a method for the production of a core body in which an increase in the leakage of magnetic flux and an increase in loss can be prevented and in which misalignment of the plurality of outer peripheral iron core portions due to magnetostriction can be prevented are desired.

According to a first aspect, there is provided a reactor, comprising an outer peripheral iron core composed of a plurality of outer peripheral iron core portions and at least three iron core coils arranged inside the outer peripheral iron core, wherein the at least three iron core coils comprise iron cores coupled to the plurality of iron core portions and coils wound onto the iron cores, respectively, and gaps, which can be magnetically coupled, are formed between one of the at least three iron cores and another iron core adjacent thereto, the reactor further comprising connection parts for connecting the plurality of outer peripheral core portions to each other.

In the first aspect, since the plurality of outer peripheral iron core portions are connected by the connection parts, it is possible to prevent the plurality of outer peripheral iron core portions from becoming misaligned due to magnetostriction.

The object, features, and advantages of the present invention, as well as other objects, features and advantages, will be further clarified by the detailed description of the representative embodiments of the present invention shown in the accompanying drawings.

DETAILED DESCRIPTION

Figure 1:
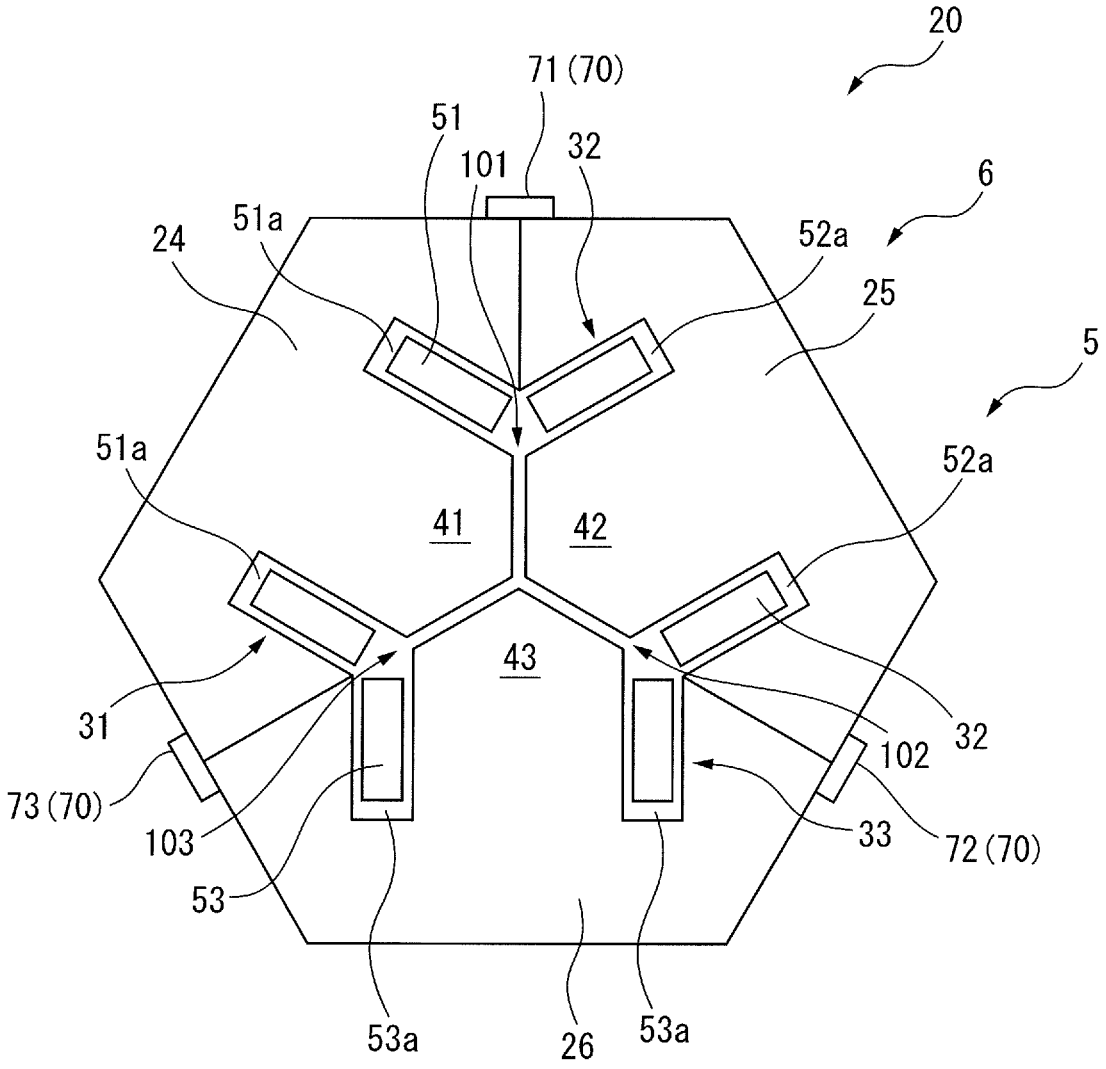
FIG. 1 is a cross-sectional view of the core body of a reactor according to a first embodiment.

The embodiments of the present invention will be described below with reference to the accompanying drawings. In the following drawings, the similar components are given the similar reference numerals. For ease of understanding, the scales of the drawings have been appropriately modified.

In the following description, a three-phase reactor will be mainly described as an example. However, the present disclosure is not limited in application to a three-phase reactor but can be broadly applied to any multiphase reactor requiring constant inductance in each phase. Further, the reactor according to the present disclosure is not limited to those provided on the primary side or secondary side of the inverters of industrial robots or machine tools but can be applied to various machines.

FIG. 1 is a cross-sectional view of the core body of a reactor according to a first embodiment. As shown in FIG. 1, a core body 5 of a reactor 6 includes an annular outer peripheral iron core 20 and three iron core coils 31 to 33 arranged inside the outer peripheral core 20. In FIG. 1, the iron core coils 31 to 33 are arranged inside the substantially hexagonal outer peripheral iron core 20. These iron core coils are arranged at equal intervals in the circumferential direction of the core body 5.

Note that the outer peripheral iron core 20 may have another rotationally-symmetrical shape, such as a circular shape. Furthermore, the number of the iron cores may be a multiple of three, whereby the reactor 6 can be used as a three-phase reactor. As can be understood from the drawing, the iron core coils 31 to 33 include iron cores 41 to 43 extending in the radial direction of the outer peripheral iron core 20 and coils 51 to 53 wound onto the iron cores 41 to 43, respectively.

The outer peripheral iron core 20 is composed of a plurality of, for example, three, outer peripheral iron core portions 24 to 26 divided in the circumferential direction. The outer peripheral iron core portions 24 to 26 are formed integrally with the iron cores 41 to 43, respectively. The outer peripheral iron core portions 24 to 26 and the iron cores 41 to 43 are formed by stacking a plurality of iron plates, carbon steel plates, electromagnetic steel sheets, or the like. When the outer peripheral iron core 20 is formed from a plurality of outer peripheral iron core portions 24 to 26, even if the outer peripheral iron core 20 is large, such an outer peripheral iron core 20 can be easily manufactured. Note that the number of iron cores 41 to 43 and the number of iron core portions 24 to 26 need not necessarily be the same.

The coils 51 to 53 are arranged in coil spaces 51*a* to 53*a* formed between the outer peripheral iron core portions 24 to 26 and the iron cores 41 to 43, respectively. In the coil spaces 51*a* to 53*a*, the inner peripheral surfaces and the outer peripheral surfaces of the coils 51 to 53 are adjacent to the inner walls of the coil spaces 51*a* to 53*a*.

Further, the radially inner ends of the iron cores 41 to 43 are each located near the center of the outer peripheral iron core 20. In the drawing, the radially inner ends of the iron cores 41 to 43 converge toward the center of the outer peripheral iron core 20, and the tip angles thereof are approximately 120 degrees. The radially inner ends of the iron cores 41 to 43 are separated from each other via gaps 101 to 103, through which magnetic connection can be established.

In other words, the radially inner end of the iron core 41 is separated from the radially inner ends of the two adjacent iron cores 42 and 43 via gaps 101 and 103. The same is true for the other iron cores 42 and 43. Note that, the sizes of the gaps 101 to 103 are equal to each other.

In the configuration shown in FIG. 1, since a central iron core disposed at the center of the core body 5 is not needed, the core body 5 can be constructed lightly and simply. Further, since the three iron core coils 31 to 33 are surrounded by the outer peripheral iron core 20, the magnetic fields generated by the coils 51 to 53 do not leak to the outside of the outer peripheral core 20. Furthermore, since the gaps 101 to 103 can be provided at any thickness at a low cost, the configuration shown in FIG. 1 is advantageous in terms of design, as compared to conventionally configured reactors.

Further, in the core body 5 of the present disclosure, the difference in the magnetic path lengths is reduced between the phases, as compared to conventionally configured reactors. Thus, in the present disclosure, the imbalance in inductance due to a difference in magnetic path length can be reduced.

Figure 2:
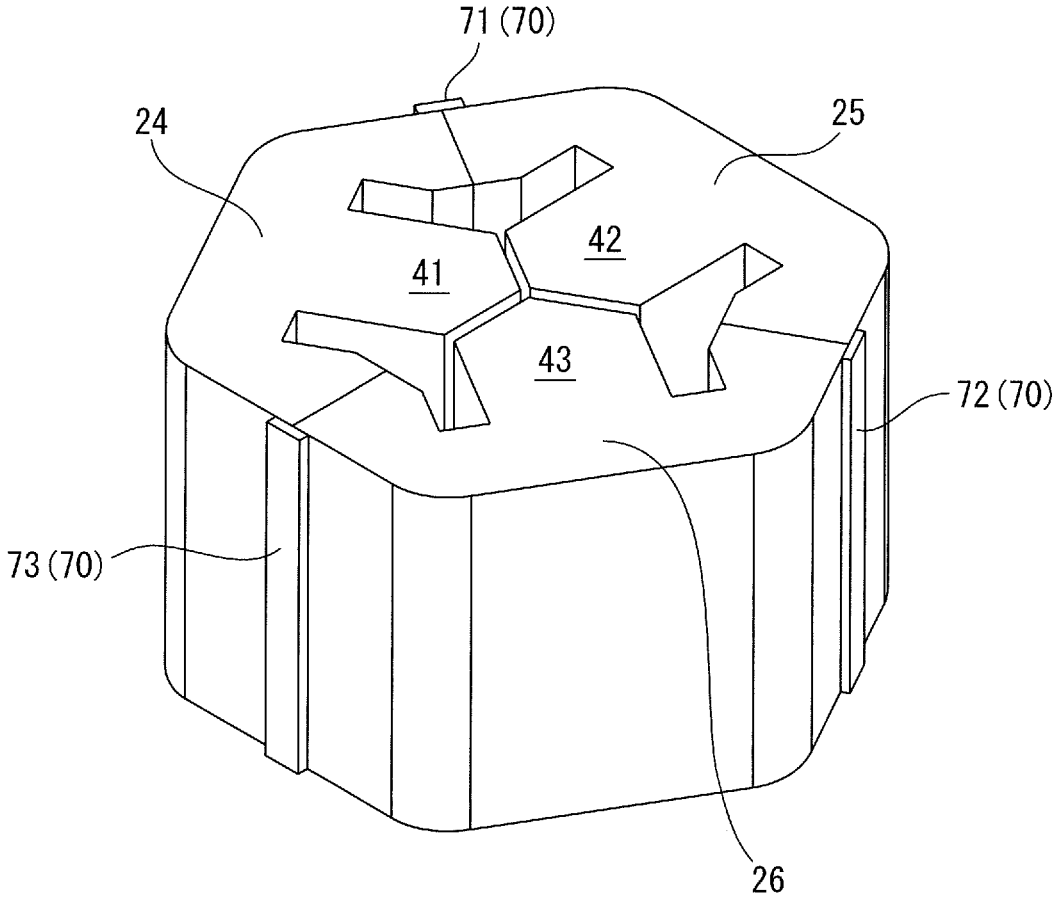
FIG. 2 is a perspective view of the core body shown in FIG. 1.

Further, FIG. 2 is a perspective view of the core body 5 shown in FIG. 1. For the ease of understanding, illustration of the coils 51 to 53 may be omitted in FIG. 2 and the other drawings described later. In FIG. 1 and FIG. 2, weld portions 71 to 73 as connection parts 70 are provided on the outer circumferential surface of the outer peripheral iron core 20 between the outer peripheral iron core portions 24 to 26. As shown, the weld portions 71 to 73 are formed by welding the regions between the outer peripheral surfaces of the outer peripheral iron core portions 24 to 26 in the axial direction. These outer iron core portions 24 to 26 may be provided only partially in the axial direction.

Figure 3A:
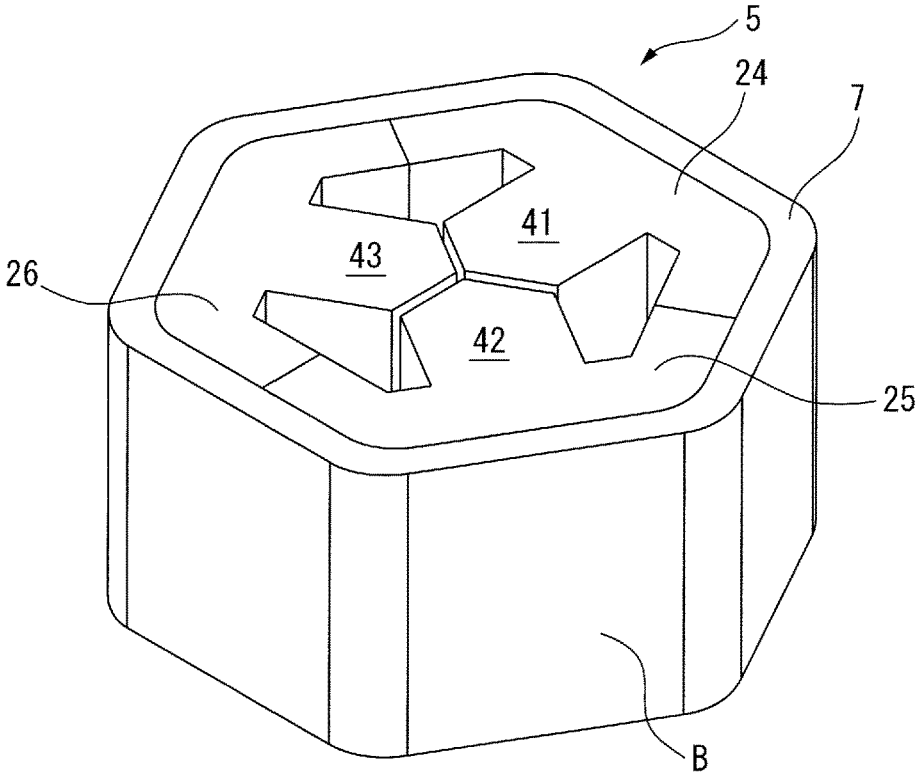
FIG. 3A is perspective view of a reactor according to the prior art.
Figure 3B:
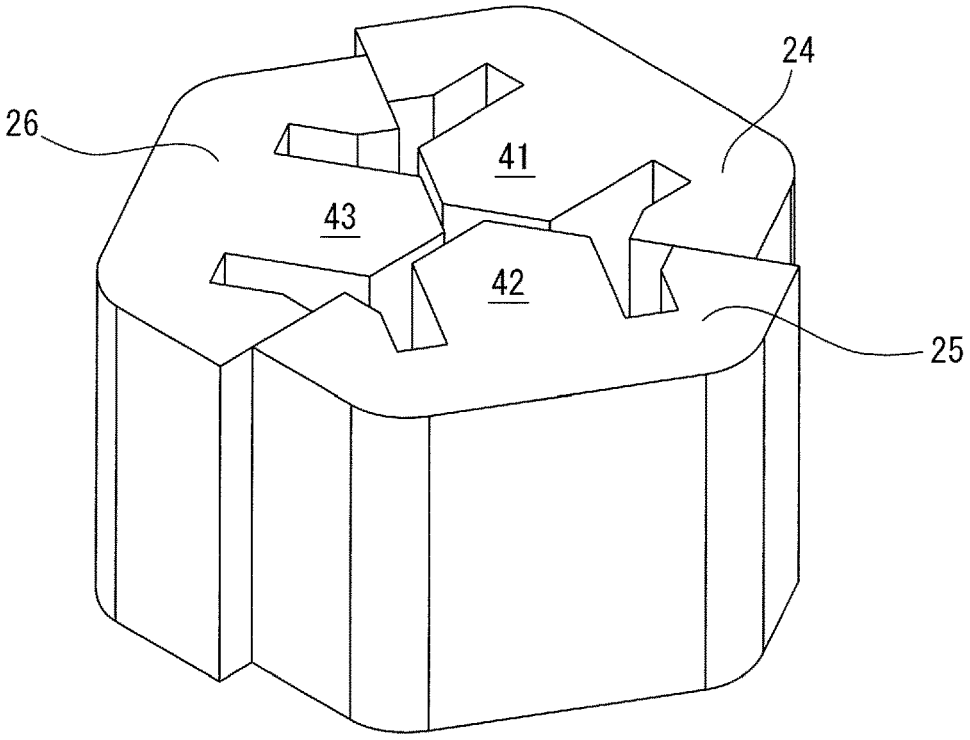
FIG. 3B is a perspective view of another reactor according to the prior art.

FIG. 3B is a perspective view of a reactor according to the prior art. In FIG. 3B, there is a risk that the outer peripheral iron core portions 24 to 26, which are integrally formed with the iron cores 41 to 43, will become misaligned.

In order to prevent such misalignment, in FIG. 3A, a band B made from an elastic body is coupled to the periphery of the core body 5. When the connection surfaces between the outer peripheral iron core portions are flat and are not the most convex portions of the outer peripheral iron core, there is a risk that a slight misalignment may occur along the connection surfaces due solely to the winding of the band.

In this connection, in the first embodiment, the plurality of outer peripheral iron cores 24 to 26 can be connected to each other by the weld portions 71 to 73 as connection parts 70. Since the dimensions of the weld portions 71 to 73 may be very small as compared to the band B, an increase in size of the reactor 6 can be prevented and misalignment of the outer peripheral iron core portions 24 to 26 can be prevented. Note that the weld portions 71 to 73 may be provided only partially in the axial direction.

Figure 4A:
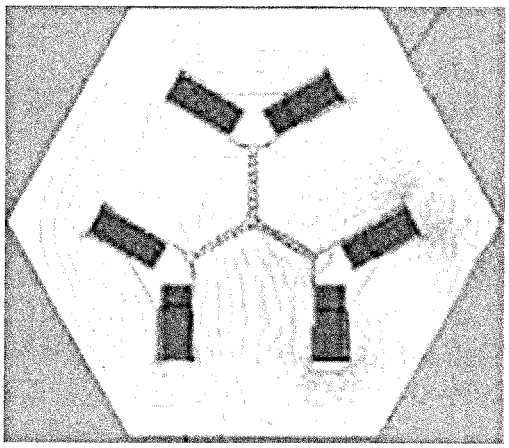
FIG. 4A is a first view showing the magnetic flux density of the reactor of the first embodiment.
Figure 4B:
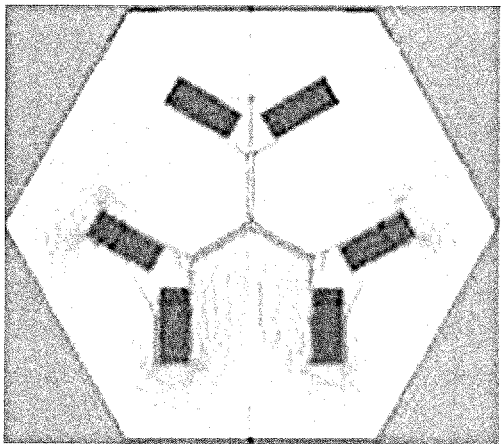
FIG. 4B is a second view showing the magnetic flux density of the reactor of the first embodiment.
Figure 4C:
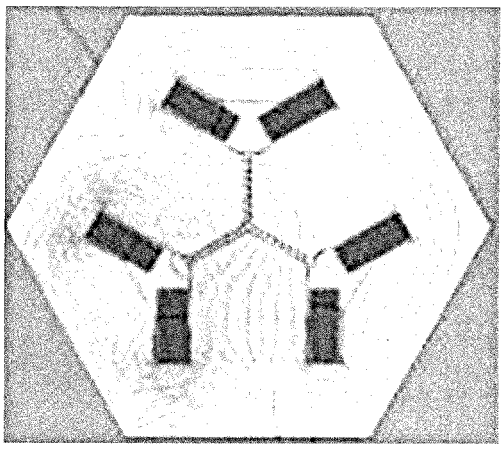
FIG. 4C is a third view showing the magnetic flux density of the reactor of the first embodiment.
Figure 4D:
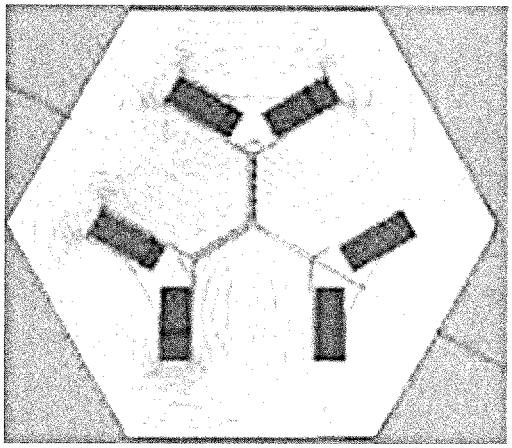
FIG. 4D is a fourth view showing the magnetic flux density of the reactor of the first embodiment.
Figure 4E:
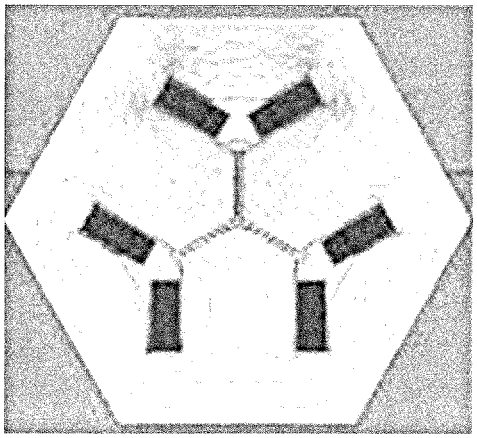
FIG. 4E is a fifth view showing the magnetic flux density of the reactor of the first embodiment.
Figure 4F:
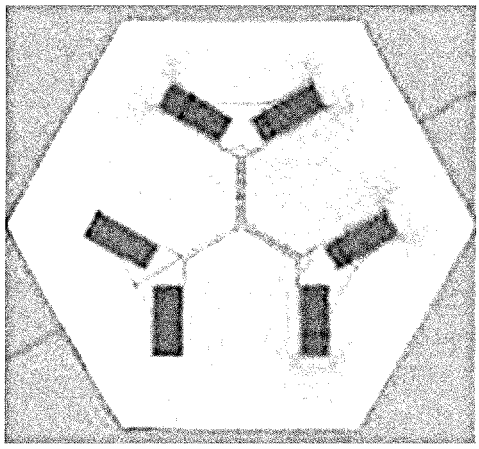
FIG. 4F is a sixth view showing the magnetic flux density of the reactor of the first embodiment.
Figure 5:
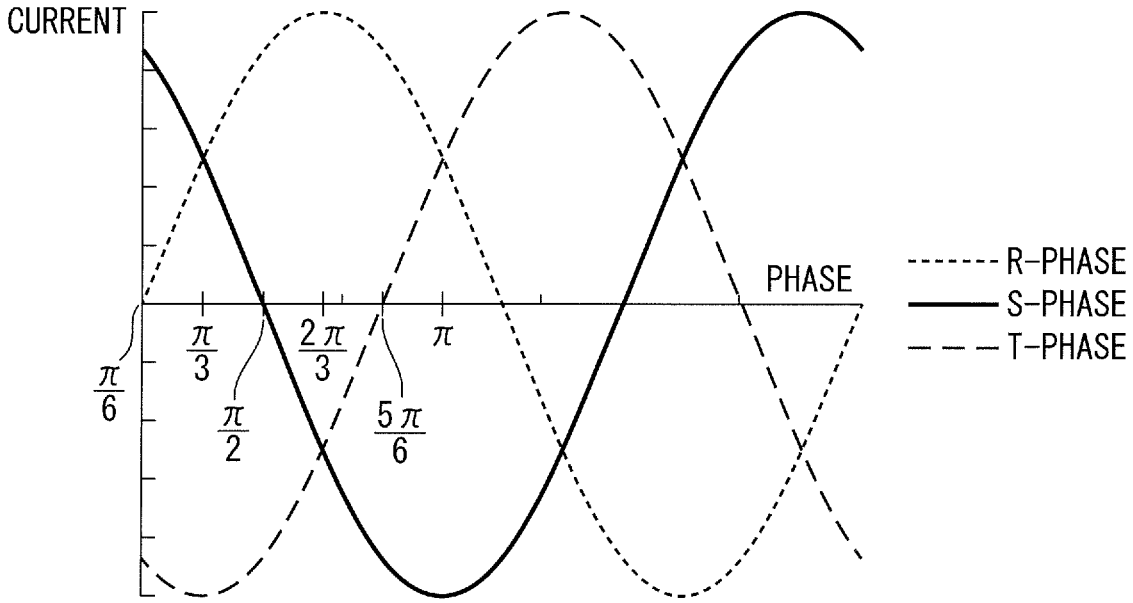
FIG. 5 is a view showing the relationship between phase and current.

FIG. 4A through FIG. 4F show the magnetic flux density of the reactor of the first embodiment. FIG. 5 shows the relationship between phase and current. Further, FIG. 4A is an end view of the outer peripheral iron core according to the first embodiment. In FIG. 5, the iron cores 41 to 43 of the core body 5 of FIG. 1A are set as the R-phase, S-phase, and T-phase, respectively. Further, in FIG. 5, the current of the R-phase is indicated by the dotted line, the current of the S-phase is indicated by the solid line, and the current of the T-phase is indicated by the dashed line.

In FIG. 5, when the electrical angle is $\pi/6$, the magnetic flux density shown in FIG. 4A is obtained. Likewise, when the electrical angle is $\pi/3$, the magnetic flux density shown in FIG. 4B is obtained. When the electrical angle is $\pi/2$, the magnetic flux density shown in FIG. 4C is obtained. When the electrical angle is $2\pi/3$, the magnetic flux density shown in FIG. 4D is obtained. When the electrical angle is $5\pi/6$, the magnetic flux density shown in FIG. 4E is obtained. When the electrical angle is $\pi$, the magnetic flux density shown in FIG. 4F is obtained.

As can be understood from FIG. 4A through FIG. 4F, the magnetic flux densities in the regions of the connection surfaces between the outer peripheral iron core portions 24 to 26 are lower than the magnetic flux density in the remaining portions of the outer peripheral iron core 20. This is because the widths of the iron cores near the connection surfaces through which the magnetic flux passes are designed to be wider than the other portions of the outer peripheral iron core. Therefore, it is preferable to provide the connection parts 70 in the areas of the connection surfaces between the outer peripheral iron core portions, which have been designed based on such a concept. In such a case, influence on the magnetic properties of the reactor 6 can be reduced and the outer peripheral iron core portions can be connected to each other.

Figure 6A:
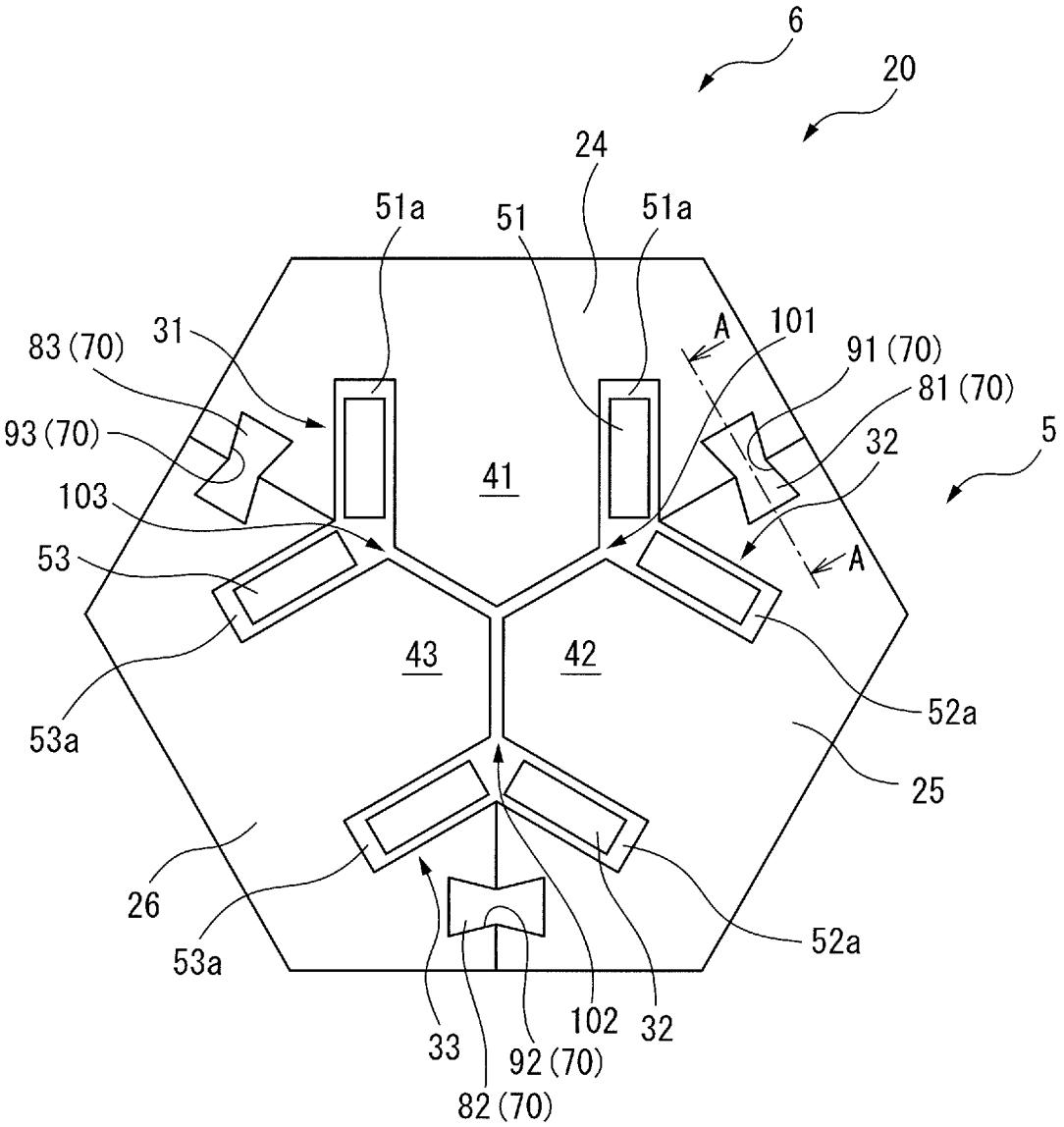
FIG. 6A is a cross-sectional view of the core body of a reactor according to a second embodiment.
Figure 6B:
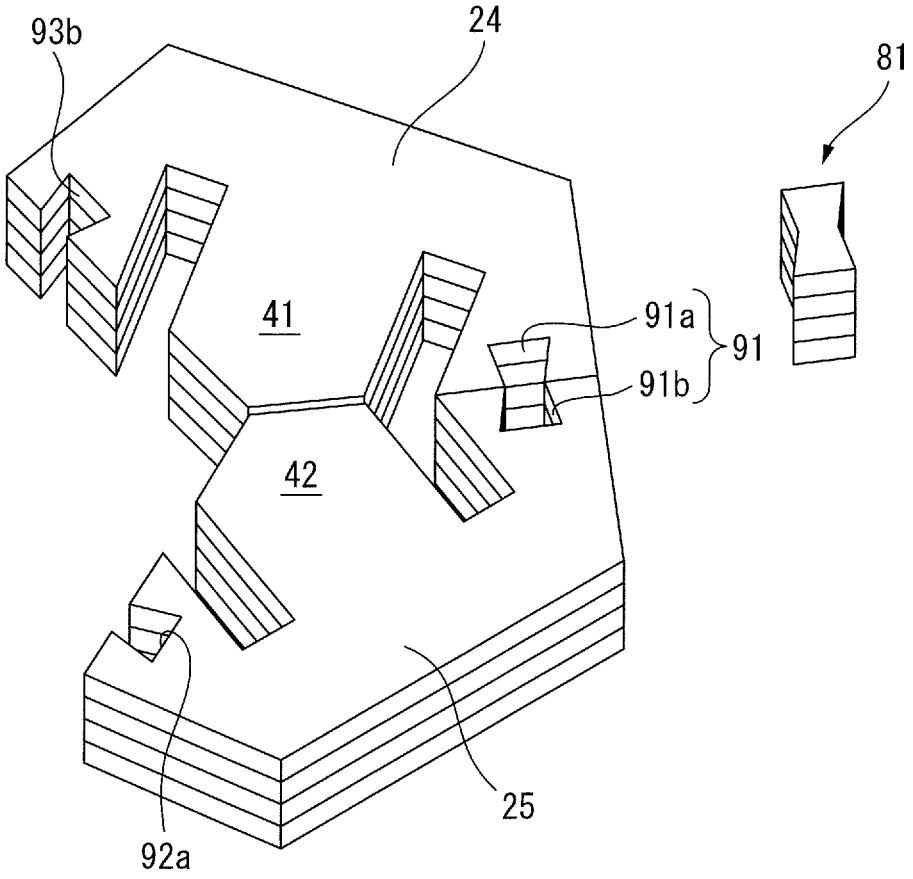
FIG. 6B is a partial perspective view of the core body shown in FIG. 6A.

FIG. 6A is a cross-sectional view of the core body of a reactor according to a second embodiment, and FIG. 6B is a partial perspective view of the core body shown in FIG. 6A. In the second embodiment, the connection parts 70 include through-holes 91 to 93 formed between the outer peripheral iron core portions 24 to 26 and connection members 81 to 83 which are inserted into and fitted in the through-holes 91 to 93.

As shown in FIG. 6B, the outer peripheral iron core portions 24 and 25 are formed by stacking a plurality of magnetic plates. The through-hole 91 is composed of a recess part 91*a* formed in the connection surface of the outer peripheral iron core portion 24 and a recess part 91*b* formed in the connection surface of the other outer peripheral iron core portion 25 adjacent thereto. The shapes of the recess part 91*a* and the recess part 91*b* may be different from each other. The connection member 81 having a shape corresponding to the through-hole 91 is inserted into the through-hole 91, whereby the outer peripheral iron core portion 24 and the outer peripheral iron core portion 25 are connected to each other.

It is preferable that the cross-sections of the recess parts 91*a* and 91*b* have portions which are wide with respect to the entrances of the recess parts 91*a* and 91*b*. It can be understood that when the connection member 81 is fitted into the through-hole 91 formed from the recess parts 91*a* and 91*b*, it is possible to tightly connect the outer peripheral iron core portion 24 and the outer peripheral iron core portions 25 to each other. The same is true for the other through-holes 92 and 93.

In the second embodiment, when the connection parts 70 are used, it is possible to easily connect the outer peripheral iron core portions 24 to 26 as compared to welding. Further, it is also possible to disassemble and reassemble the reactor 6.

In the second embodiment, a plurality of magnetic plates, for example, iron plates, carbon steel plates, electromagnetic steel plates, etc., are stacked, and portions corresponding to the connection members 81 to 83 are punched from the stacked magnetic plates, whereby the connection members 81 to 83 are formed. Then, portions corresponding to the outer peripheral iron core portions 24 to 26 and the iron cores 41 to 43, which are integrally formed therewith, are punched from the stacked magnetic plates. In this case, it is not necessary to prepare additional members in order to form the connection members 81 to 83. However, the connection members 81 to 83 may be separately formed as single members.

Furthermore, when the connection members 81 to 83 are formed from a plurality of magnetic plates, the connection members 81 to 83 are magnetic materials. In contrast thereto, when the connection members are formed from a non-magnetic material, the magnetic properties of the reactor 6 at the locations of the connection members are influenced by the connection members, whereby magnetic flux saturation is promoted. However, when the connection members 81 to 83 are formed from a magnetic material, such a problem can be avoided.

Figure 7A:
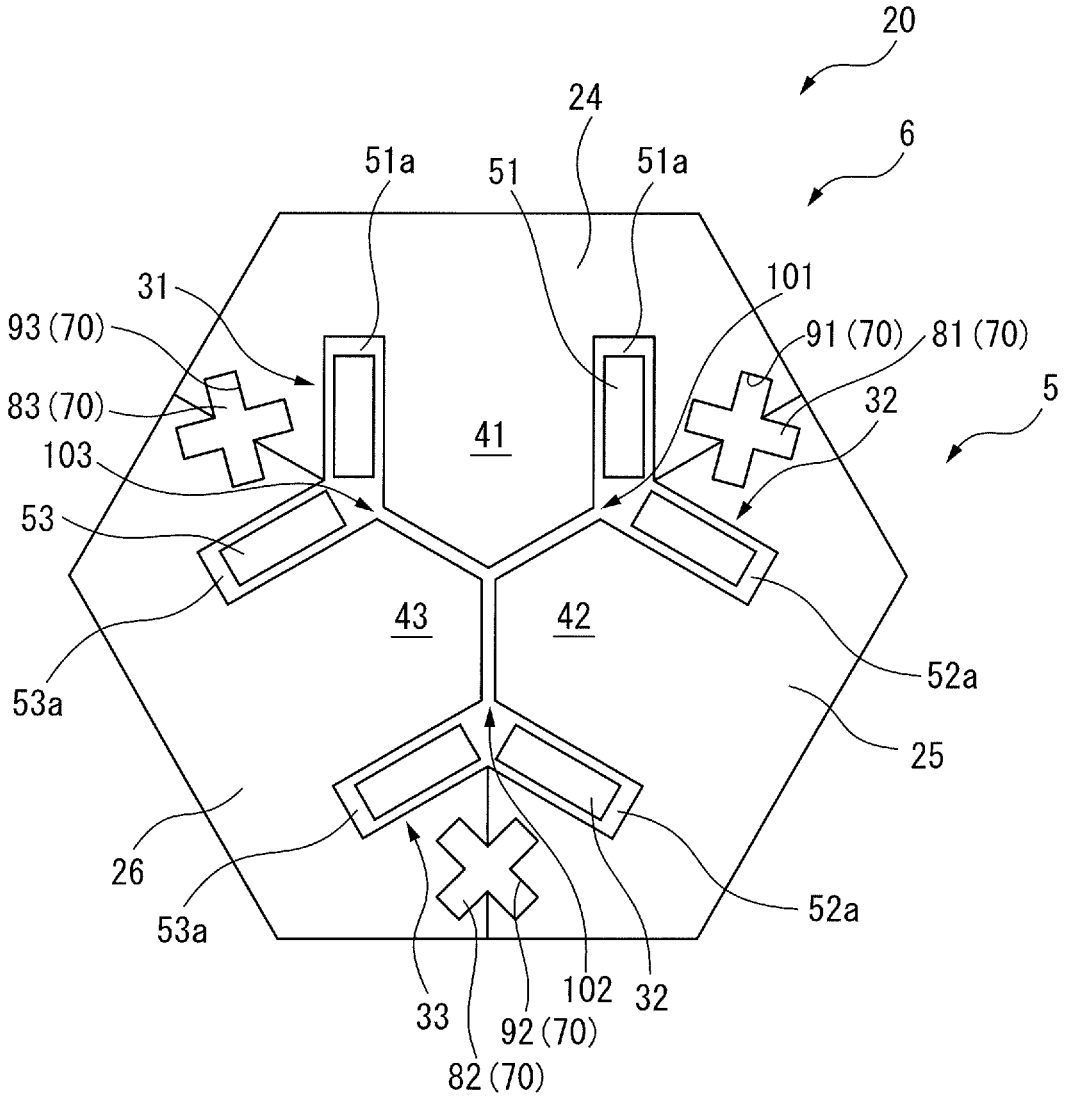
FIG. 7A is a cross-section view of the core body of another reactor according to the second embodiment.
Figure 7B:
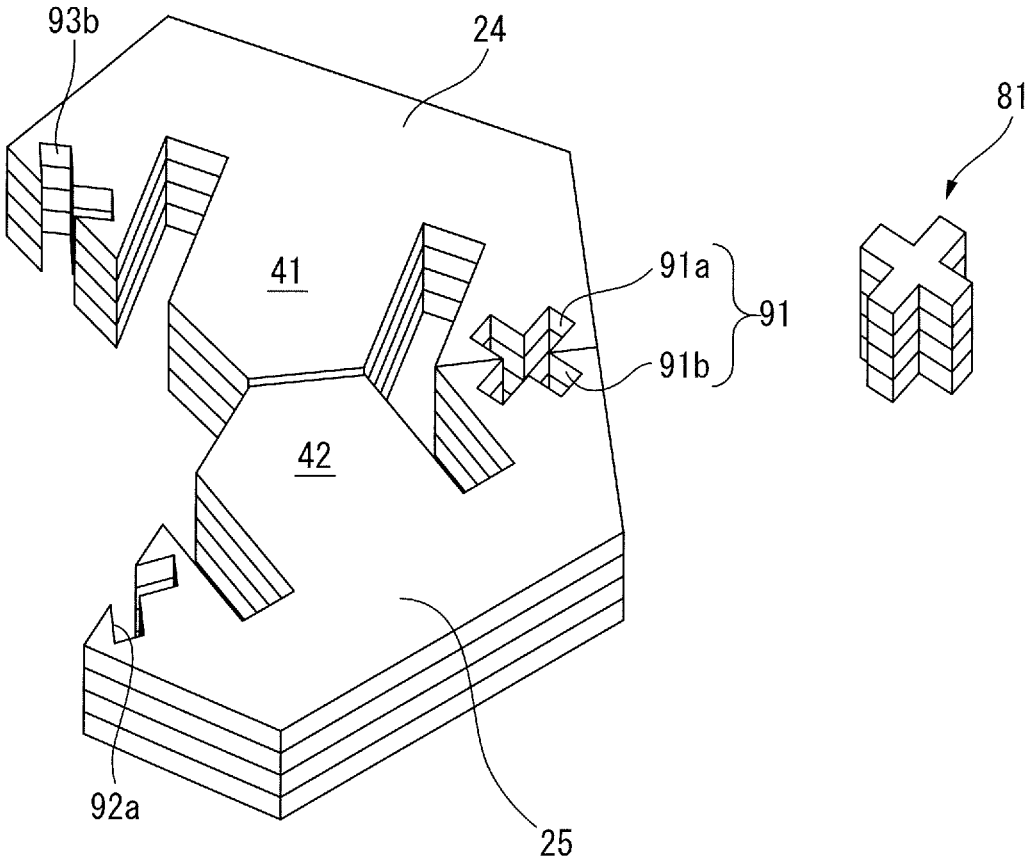
FIG. 7B is a partial perspective view of the core body shown in FIG. 7A.

FIG. 7A is a cross-sectional view of the core body of another reactor according to the second embodiment, and FIG. 7B is a partial perspective view of the core body shown in FIG. 7A. The through-hole 91 formed from the recess parts 91*a* and 91*b* shown in these drawings is substantially X-shaped. In such a case, since the through-hole 91 and the connection member 81 have a more complicated fitting, it can be understood that the outer peripheral iron core portion 24 and the outer peripheral iron core portion 25 can be connected more tightly. The configurations of the connection members 81 to 83 are the same as described above. The through-holes 91 to 93 may have other shapes.

Figure 8:
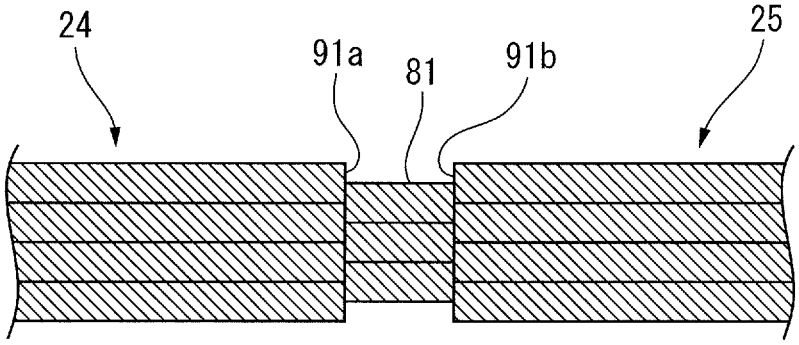
FIG. 8 is a longitudinal cross-sectional view taken along line A-A of FIG. 6A.

FIG. 8 is a longitudinal cross-sectional view taken along line A-A of FIG. 6A. The connection member 81 shown in FIG. 8 is formed by stacking a plurality of magnetic plates. The connection member 81 is shifted in the stacking direction by a distance smaller than the thickness of one of the magnetic plates. In other words, one of the magnetic plates of the connection member 81 contacts two of the plurality of magnetic plates constituting the outer peripheral iron core portion 24 and the outer peripheral iron core portion 25. The aforementioned distance is preferably half the thickness of one magnetic plate. In this case, the outer peripheral iron core portions 24 and 25 can be connected with a simple structure.

As shown in FIG. 8, the number of the magnetic plates of the connection member 81 is preferable smaller than the number of the magnetic plates constituting the outer peripheral iron core portion 24 and the outer peripheral iron core portion 25. As a result, it is possible to prevent the end surfaces of the connection member 81 from protruding from the end surfaces of the outer peripheral iron core portions 24 and 25.

Figure 9:
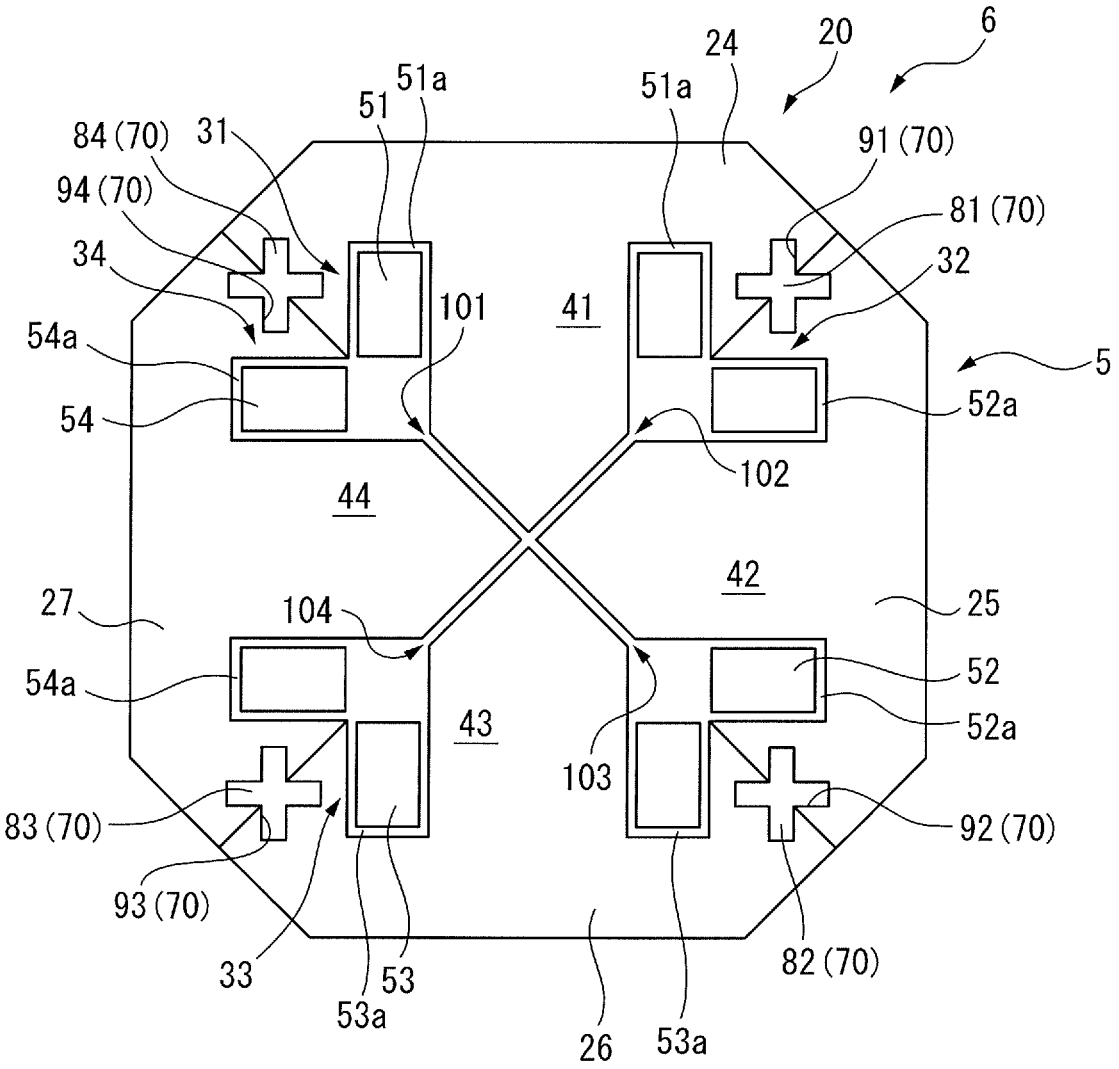
FIG. 9 is a cross-section view of a reactor according to a third embodiment.

Further, FIG. 9 is a cross-sectional view of a reactor according to a third embodiment. The core body 5 of the reactor 6 shown in FIG. 9 includes a substantially octagonal outer peripheral iron core 20 composed of the outer peripheral iron core portions 24 to 26 and four iron core coils 31 to 34, which are similar to the aforementioned iron core coils. These iron core coils 31 to 34 are arranged at substantially equal intervals in the circumferential direction of the reactor 6. Furthermore, the number of the iron cores is preferably an even number of 4 or more, so that the reactor 6 can be used as a single-phase reactor.

As can be understood from the drawing, the iron core coils 31 to 34 include iron cores 41 to 44 extending in the radial direction and coils 51 to 54 wound onto the respective iron cores, respectively. The radially outer ends of the iron cores 41 to 44 are integrally formed with the respective outer peripheral iron core portions 24 to 26.

Further, each of the radially inner ends of the iron cores 41 to 44 is located near the center of the outer peripheral iron core 20. In FIG. 9, the radially inner ends of the iron cores 41 to 44 converge toward the center of the outer peripheral iron core 20, and the tip angles thereof are about 90 degrees. The radially inner ends of the iron cores 41 to 44 are separated from each other via the gaps 101 to 104, through which magnetic connection can be established.

In FIG. 9, through-holes 91 to 94 having substantially X-shapes are formed in the connection surfaces of the outer peripheral iron core portions 24 to 27. The connection members 81 to 84, which are similar to the aforementioned connection members, are inserted and fitted into the through-holes 91 to 94. Thus, in the third embodiment, it can be understood that the similar effects as described above can be obtained. Furthermore, in an un-illustrated embodiment, the through holes may have shapes which are different from each other.

Figure 10A:
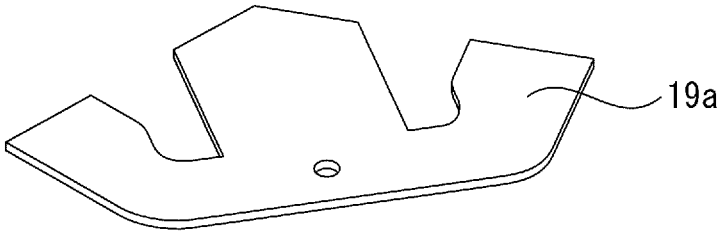
FIG. 10A is a first view detailing the production of the core body of a reactor according to a fourth embodiment.
Figure 10B:
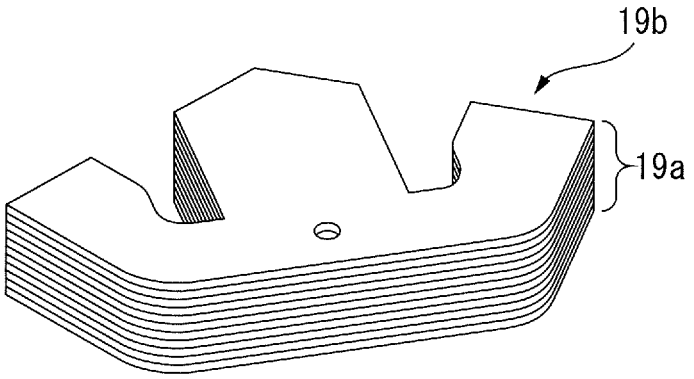
FIG. 10B is a second view detailing the production of the core body of the reactor according to the fourth embodiment.
Figure 10C:
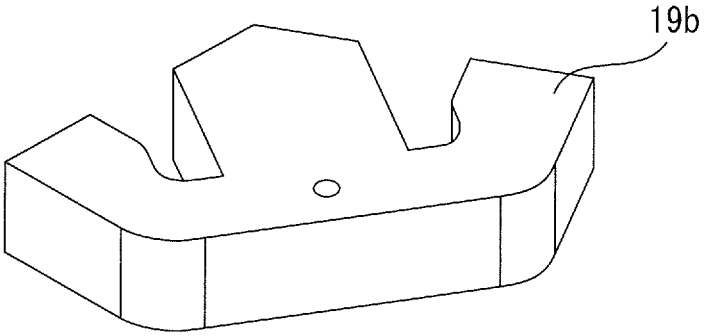
FIG. 10C is a third view detailing the production of the core body of the reactor according to the fourth embodiment.

FIG. 10A through FIG. 10E are views detailing the production of the core body of a reactor according to a fourth embodiment. First, as shown in FIG. 10A, a magnetic plate 19*a* having a shape corresponding to the iron core 41, having the outer peripheral iron core 24 integrally formed therewith, is prepared. Magnetic foil may be used in place of the magnetic plate 19*a*. Then, as shown in FIG. 10B and FIG. 10C, a predetermined number, for example, twenty, magnetic plates 19*a* having the same shape are stacked, whereby an iron core block 19*b* is produced. The plurality of magnetic plates 19*a* in the iron core block 19*b* are preferably affixed to each other using an adhesive or the like. For the sake of brevity, illustration of the magnetic plates 19*a* in the iron core block 19*b* has been omitted in FIG. 10C and the drawings described later.

Figure 10D:
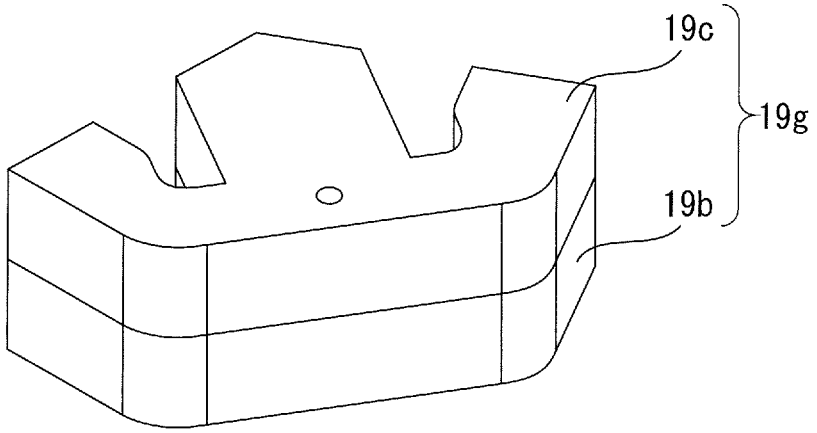
FIG. 10D is a fourth view detailing the production of the core body of the reactor according to the fourth embodiment.
Figure 10E:
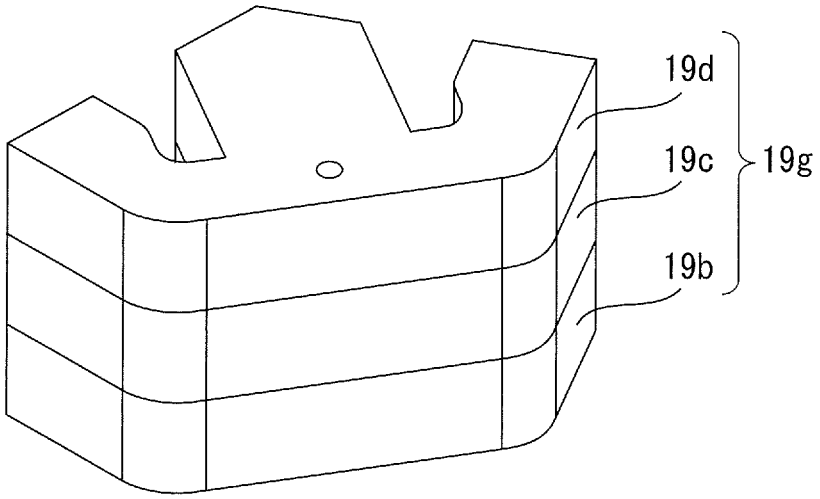
FIG. 10E is a fifth view detailing the production of the core body of the reactor according to the fourth embodiment.

Another iron core block 19*c* is produced from a predetermined number, for example, twenty, magnetic plates 19*a* by the same method. As shown in FIG. 10D, the iron core block 19*b* and the iron core block 19*c* are accumulated on each other. The direction of accumulating is equal to the stacking direction of the magnetic plates 19*a*. As a result, an iron core block assembly 19*g* is produced. When it is necessary to increase the length of the core body 5 in the axial direction, another produced iron core block 19*d* may be further added (refer to FIG. 10E).

The iron core block assembly 19*g* corresponds to one iron core 41 of the core body 5 having one outer peripheral iron core portion 24 formed integrally therewith. Other iron core block assemblies 19*g* corresponding to the iron cores 42 and 43 are produced by the same method. The core body 5 is produced by assembling these iron core block assemblies 19*g* in the circumferential direction. The aforementioned connection parts 70 are preferably used after assembling at least three iron core block assemblies 19*g*.

In general, the core bodies 5 of reactors 6 have different axial lengths according to the type thereof. In the prior art, since only a plurality of magnetic plates 18*a* are stacked, it is necessary to perform different manufacturing management and maintenance for each type of core body 5 on a magnetic plate 19*a* basis. This is complicated, especially when the axial length of the core body 5 is relatively large. In this connection, in the fourth embodiment, since manufacturing management and maintenance can be performed on the basis of the iron core blocks 19*b* to 19*d*, it is possible to reduce the labor of manufacturing management and maintenance.

Aspects of the Present Disclosure According to the first aspect, there is provided a reactor (6), comprising an outer peripheral iron core (20) composed of a plurality of outer peripheral iron core portions (24 to 27) and at least three iron core coils (31 to 34) arranged inside the outer peripheral iron core, wherein the at least three iron core coils comprise iron cores (41 to 44) coupled to the plurality of iron core portions and coils (51 to 54) wound onto the iron cores, respectively, and gaps (101 to 104), which can be magnetically coupled, are formed between one of the at least three iron cores and another iron core adjacent thereto, the reactor further comprising connection parts (70) for connecting the plurality of outer peripheral core portions to each other.

According to the second aspect, in the first aspect, the outer peripheral iron core portions and the iron cores are formed by stacking a plurality of plates in a stacking direction.

According to the third aspect, in the first or second aspect, the connection parts include weld portions (71 to 73) which connect the plurality of outer peripheral core portions to each other by welding.

According to the fourth aspect, in the second aspect or third aspect, the connection parts include connection members (81 to 84) fitted between the plurality of outer peripheral iron core portions to connect the plurality of outer peripheral iron core portions to each other.

According to the fifth aspect, in the fourth aspect, the connection members are inserted into holes (91 to 94) formed between the plurality of outer peripheral iron core portions.

According to the sixth aspect, in the fourth or fifth aspect, the connection members are formed by stacking a plurality of plates in the stacking direction, and the connection members are shifted with respect to the plurality of plates constituting the plurality of outer peripheral iron core portions in the stacking direction by a distance smaller than the thickness of one of the plurality of plates.

According to the seventh aspect, in any of the fourth through sixth aspects, the connection members are formed from a magnetic material.

According to the eighth aspect, in any of the first through seventh aspects, the number of the at least three iron core coils is a multiple of three.

According to the ninth aspect, in any of the first through seventh aspects, the number of the at least three iron core coils is an even number not less than 4.

According to the tenth aspect, there is provided a method for the production of a core body (5), the core body comprising an outer peripheral iron core (20) composed of a plurality of outer peripheral iron core portions (24 to 27) and at least three iron cores (41 to 44) integral with the plurality of outer peripheral iron core portions, respectively; the method comprising the steps of forming a first iron core block (19*b*) by stacking, in the axial direction of the core body, a plurality of magnetic plates (19*a*) or magnetic foils having a shape corresponding to one iron core of the at least three iron cores, forming a second iron core block (19*c*) by stacking, in the axial direction of the core body, a plurality of magnetic plates or magnetic foils having a shape corresponding to the one iron core of the at least three iron cores, accumulating the first iron core block on the second iron core block, and forming the remaining iron cores of the at least three iron cores similarly, so as to produce the core body.

Effects of the Aspects

In the first aspect, since the plurality of outer peripheral iron core portions are connected by the connection parts, it is possible to prevent the plurality of outer peripheral iron core portions from becoming misaligned due to magnetostriction.

In the second aspect, the outer peripheral iron core portions and the iron cores can be easily assembled.

In the third aspect, since the plurality of outer peripheral iron core portions are connected to each other via welding, it is possible to prevent the size of the reactor from increasing.

In the fourth aspect, by using the connection members, the plurality of outer peripheral iron core portions can be easily connected. Furthermore, disassembly and assembly of the reactor is easy. In the fifth aspect, since the connection members are inserted into the holes, the plurality of outer peripheral iron core portions can be tightly connected, and it is possible to prevent an increase in the size of the reactor.

In the sixth aspect, since the connection members are shifted in the stacking direction, the plurality of outer peripheral iron core portions can be tightly connected to each other with a simple configuration. Furthermore, since the connection members and the plurality of outer peripheral iron core portions can be produced by punching a plurality of stacked plates, it is not necessary to prepare additional members in order to produce the connection members.

When the connection members are made from a non-magnetic material, the magnetic properties of the reactor at the locations of the connection members are influenced by the connection members, whereby magnetic flux tends to saturate. In the seventh aspect, since the connection members are formed from a magnetic material, such a problem can be avoided.

In the eighth aspect, the reactor can be used as a three-phase reactor.

In the ninth aspect, the reactor can be used as a single-phase reactor.

In the tenth aspect, since manufacturing control and maintenance can be performed on an iron core block basis, the labor for manufacturing control and maintenance can be reduced.

Though the present invention has been described using representative embodiments, a person skilled in the art would understand that the foregoing modifications and various other modifications, omissions, and additions can be made without departing from the scope of the present invention.

The invention claimed is:

1. A reactor, comprising an outer peripheral iron core composed of a plurality of outer peripheral iron core portions and at least three iron core coils arranged inside the outer peripheral iron core, wherein the at least three iron core coils comprise iron cores coupled to the plurality of iron core portions and coils wound onto the iron cores, respectively, and gaps, which can be magnetically coupled, are formed between one of the at least three iron cores and another iron core adjacent thereto, wherein radial inner ends of the iron cores are located near a center of the outer peripheral iron core and converge towards the center of the outer peripheral iron core, and wherein the radial inner end of each iron core is separate from the radial inner ends of the adjacent iron cores;

the reactor further comprising:

connection parts for connecting the plurality of outer peripheral core portions to each other; wherein the connection parts include connection members fitted between the plurality of outer peripheral iron core portions to connect the plurality of outer peripheral iron core portions to each other; and the connection members, the plurality of outer peripheral iron core portions, and the iron cores are formed from a plurality of plates of a same material stacked in a stacking direction.

2. The reactor according to claim 1, wherein the connection members are shifted with respect to the plurality of plates constituting the plurality of outer peripheral iron core portions in the stacking direction by a distance smaller than the thickness of one of the plurality of plates.

* * * * *